US009090418B2

(12) United States Patent
Blair et al.

(10) Patent No.: US 9,090,418 B2
(45) Date of Patent: Jul. 28, 2015

(54) AUTOMATICALLY ADJUSTABLE PICK MECHANISM FOR FEEDING SHEETS OF MEDIA OF DIFFERENT WIDTHS

(71) Applicant: LEXMARK INTERNATIONAL, INC., Lexington, KY (US)

(72) Inventors: Brian A Blair, Richmond, KY (US); Dustin Daniel Fichter, Versailles, KY (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/099,033

(22) Filed: Dec. 6, 2013

(65) Prior Publication Data

US 2014/0103602 A1 Apr. 17, 2014

Related U.S. Application Data

(63) Continuation of application No. 13/651,505, filed on Oct. 15, 2012, now Pat. No. 8,636,277.

(51) Int. Cl.

| | |
|---|---|
| ***B65H 3/06*** | (2006.01) |
| ***B65H 1/18*** | (2006.01) |
| ***B65H 3/34*** | (2006.01) |
| ***B65H 1/26*** | (2006.01) |

(52) U.S. Cl.

CPC ..... *B65H 3/0684* (2013.01); *B65H 1/18* (2013.01); *B65H 1/266* (2013.01); *B65H 3/06* (2013.01); *B65H 3/34* (2013.01); *B65H 2403/411* (2013.01); *B65H 2404/1523* (2013.01); *B65H 2405/32* (2013.01); *B65H 2511/12* (2013.01); *B65H 2511/20* (2013.01); *B65H 2511/22* (2013.01)

(58) Field of Classification Search

CPC ..... B65H 1/04; B65H 1/266; B65H 3/06; B65H 3/0684; B65H 2404/152; B65H 2404/1521; B65H 2404/1523; B65H 2405/1122; B65H 2405/114; B65H 2405/1144; B65H 2405/31

USPC ..... 271/171, 117, 118

See application file for complete search history.

(56) References Cited

U.S. PATENT DOCUMENTS

| | | | | |
|---|---|---|---|---|
| 4,098,501 | A * | 7/1978 | Tani et al. | 271/117 |
| 4,231,566 | A * | 11/1980 | Suzuki | 271/117 |
| 4,351,519 | A * | 9/1982 | Jendrick | 271/117 |
| 5,294,104 | A * | 3/1994 | Nishigaki | 271/117 |
| 5,975,517 | A * | 11/1999 | Lim | 271/117 |
| 8,052,138 | B2 * | 11/2011 | Wang | 271/117 |
| 8,322,704 | B1 * | 12/2012 | Blair et al. | 271/117 |
| 8,474,812 | B1 * | 7/2013 | Blair et al. | 271/109 |
| 2007/0158901 | A1 * | 7/2007 | Lee | 271/171 |

* cited by examiner

*Primary Examiner* — Ernesto Suarez
(74) *Attorney, Agent, or Firm* — John Victor Pezdek

(57) ABSTRACT

In an imaging apparatus, a removable media tray is operative to hold a plurality of media types of different widths and a pick device includes a pick mechanism and a translation mechanism for moving the pick mechanism to a centerline of a width of one or more media sheets in the media tray. The media tray includes a reference edge surface and a media edge guide moveable to a selected position with respect to the reference edge surface. The one or more media sheets are restrained between the reference edge surface and the media edge guide with the translation mechanism automatically translating the pick mechanism to the centerline of the corresponding media width during insertion of the media tray into the imaging apparatus.

21 Claims, 16 Drawing Sheets

AUTOMATICALLY ADJUSTABLE PICK MECHANISM FOR FEEDING SHEETS OF MEDIA OF DIFFERENT WIDTHS

CROSS REFERENCES TO RELATED APPLICATIONS

Pursuant to 37 C.F.R. §1.78, this patent application is a continuation application and claims the benefit of the earlier filing date of the U.S. patent application Ser. No. 13/651,505, filed Oct. 15, 2012, also entitled "Automatically Adjustable Pick Mechanism for Feeding Sheets of Media of Different Widths."

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present disclosure relates generally to a device and a system for feeding a media sheet from a stack of media sheets and, more particularly, to a device and a system for automatically adjusting the position of a pick arm relative to a media sheet across a media feed direction.

2. Description of the Related Art

A typical image forming apparatus such as an electrophotographic printer or an inkjet printer, for example, includes a media sheet feed system having a media picking mechanism for picking a media sheet and a media tray for holding a stack of media sheets, such as paper, on which to print images. One type of picking mechanism utilizes an auto compensating pick module (ACM). The ACM includes at least one pick roller and a gear train that transmits both a rotational force and a downward force to the pick roller.

In reference edge type systems, the ACM is typically positioned to feed a wide range of media sizes without requiring adjustments. For example, the ACM may be positioned across the media feed direction such that there are two pick rollers touching any supported media from the narrowest to the widest. If two rollers are not placed on a supported media, misfeeds and paper jams may result during a sheet pick operation.

However, when the ACM is positioned to allow feeding of a narrowest supported media, pick reliability of a widest supported media may be compromised. This is because the ACM is positioned offset from the centerline of the widest supported media in order to support the narrowest supported media. When pick forces are applied to a wide media sheet, the offset location of the pick forces creates a moment on the media sheet that skews the media when picked. The skew in the media must then be removed by a downstream media alignment system before image transfer. Skewing the media during a pick operation further creates an opportunity for paper jams and increases the amount of energy that must be used on the media sheet by the alignment system.

To account for the need to feed media of different widths, the ACM may be manually repositioned about the centerline of each width supported. However, it would be advantageous to be able to automatically position the ACM based on the chosen media width. There is a need to effectively reduce pick skew and improve reliability of a picking mechanism in reference edge type systems by substantially eliminating the moment placed on the sheet by the pick rollers during a media sheet picking operation. Further, there is also a need to increase the number of different media sizes supported by a media tray in an image forming apparatus without compromising pick reliability of the widest supported media.

SUMMARY

Embodiments of the present disclosure provide for reduced pick skew and improved reliability of a picking mechanism by allowing a pick arm to be automatically and continually adjusted between a predetermined range of travel based on the position of a media edge guide across the media feed direction to accommodate a variety of media sizes such that media pick forces are substantially balanced about the centerline of a media sheet being picked.

In one example embodiment, an imaging apparatus has an input media storage location including a media alignment guide moveable by a user. The imaging apparatus uses a media picking device comprising a shaft for receiving torque, a pick arm mechanism rotatably and slidably mounted at a first end thereof on the shaft, a pick roller mounted at a second end of the pick arm mechanism for contacting a topmost media sheet of a stack of media sheets and drivable by the shaft to pick the topmost media sheet of the stack of media sheets in a media feed direction, and a translation mechanism coupled to the pick arm mechanism. The translation mechanism includes a carriage coupled with at least a portion of the first end of the pick arm and movable substantially parallel to the shaft. An actuator member is operatively coupled to the carriage and connectable to the media alignment guide, wherein when the media alignment guide moves in response to an applied force, the actuator member moves which translates the pick arm mechanism along the shaft transverse to the media feed direction and, when the media alignment guide stops, the actuator member stops and the pick arm mechanism stops translating. The predetermined length of travel of the media alignment guide defines the range of travel for the carriage and pick mechanism. A frame is disposed adjacent the translation mechanism for supporting the actuator member and the carriage. The actuator member and the carriage are each slidably attached to the frame through a plurality of bosses receivable in corresponding elongated slots having a length sufficient to accommodate the predetermined length of travel of the media alignment guide provided on the frame, the plurality of bosses sliding along their respective elongated slots when the carriage and actuator member move. The elongated slots each have a length sufficient to accommodate the predetermined length of travel of the media alignment guide.

In another example embodiment, a releasable latch is mounted on the carriage adjacent a free end of the shaft. The releasable latch, when in a first position, engages the free end to retain the pick arm mechanism on the shaft and, when in a second position, allows the pick arm mechanism to be removable from the shaft.

In another example embodiment, a stack height sensor is mounted on the carriage adjacent the pick arm for sensing an angular position of the pick arm that corresponds to a height of the media stack disposed within the media tray.

BRIEF DESCRIPTION OF THE DRAWINGS

The above-mentioned and other features and advantages of the various embodiments, and the manner of attaining them, will become more apparent and will be better understood by reference to the accompanying drawings.

FIG. 12A is a perspective view illustrating the latch in FIG. 11 in an unlatched position while

DETAILED DESCRIPTION

Figure 1:
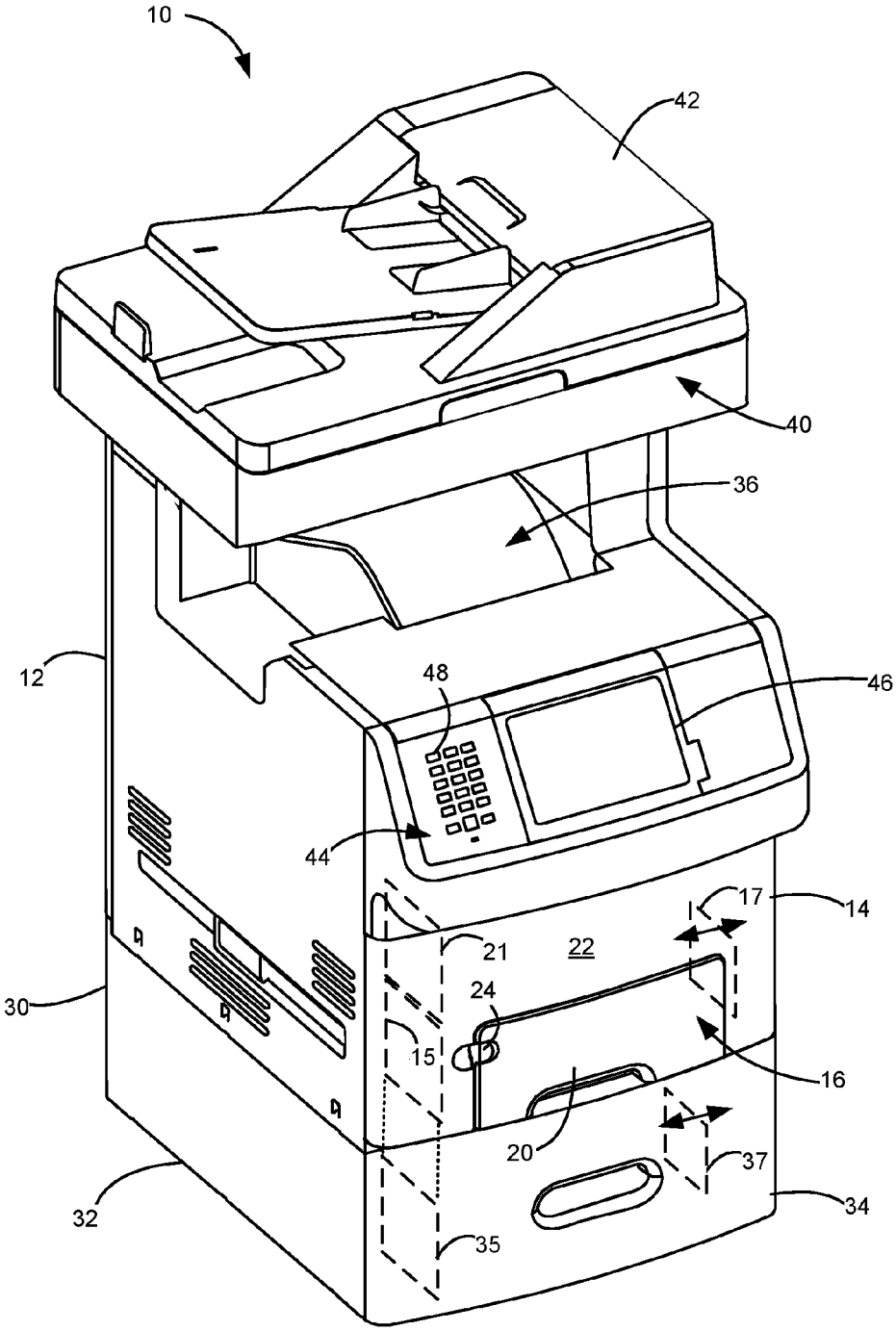
FIG. 1 is a perspective view of one example embodiment of an imaging apparatus.

The following description and drawings illustrate embodiments sufficiently to enable those skilled in the art to practice the present disclosure. It is to be understood that the disclosure is not limited to the details of construction and the arrangement of components set forth in the following description or illustrated in the drawings. The invention is capable of other embodiments and of being practiced or carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limiting sense and the scope of the present invention is defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back", "rear" and "side", "above", "under", "below", "lower", "over", "upper", and the like, are used for ease of description to explain the positioning of one element relative to a second element. These terms are generally used in reference to the position of an element in its intended working position within an image forming device. Further, terms such as "first", "second", and the like, are used to describe various elements, regions, sections, etc. and are not intended to be limiting. The term "image" as used herein encompasses any printed or digital form of text, graphic, or combination thereof. Like terms refer to like elements throughout the description.

Figure 2:
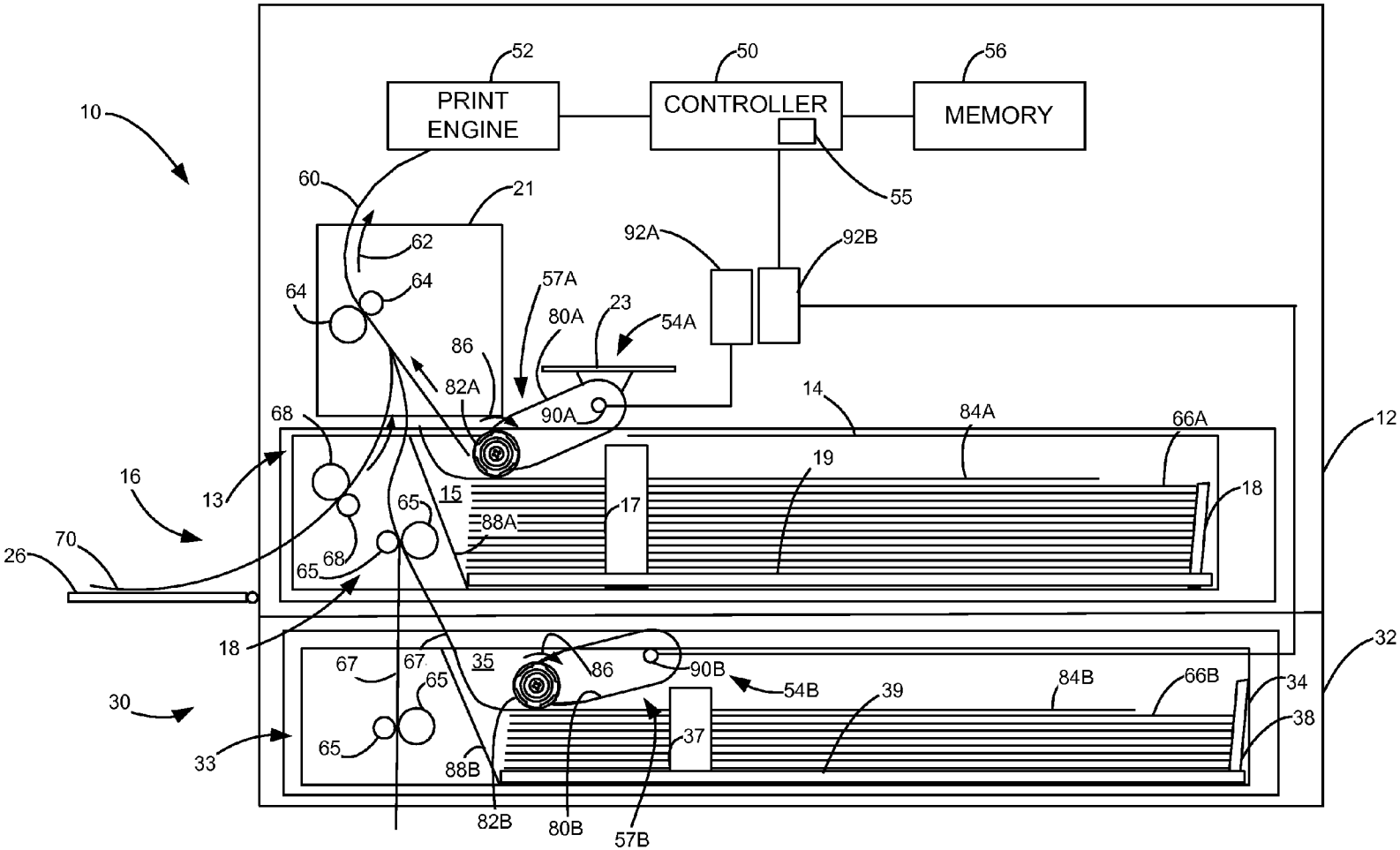
FIG. 2 is a schematic diagram of the imaging apparatus in FIG. 1.

Referring now to the drawings and particularly to FIGS. 1 and 2, there is shown an imaging apparatus 10. Imaging apparatus 10, which may be a standalone imaging device, includes a housing 12 having a moveable media support such as for example input media tray 14 for supporting sheets of media, such as, but not limited to, paper, card stock film, such as transparencies, or printer labels. The moveable media support further includes at least one media alignment guide that is moveable over a predetermined range to accommodate various widths of media. Input media tray 14 may be inserted into or removed from the housing 12 through an opening 13. Additionally, input media tray 14 may include a multi-purpose feeder (MPF) 16 disposed within a front portion 18 of input media tray 14 behind front panel 20 mounted in a wall 22 of input media tray 14. Front panel 20 may be rotatably connected to wall 22 of media tray 14 and is rotated open to provide access to MPF 16. A latch 24 is provided on front panel 20 to secure it in the closed position. Front panel 20 may be comprised of two or more overlapping segments that may be slidably extended to provide a support surface or tray 26 that supports a stack of media sheets or documents for feeding through MPF 16. One or more option assemblies 30 may be attached to imaging apparatus 10 to provide an additional input media source. Option assembly 30 includes a housing 32 and a moveable media support such as removable media input tray 34 that is slidably received into the option housing 32 via an opening 33. Media input tray 34 may be sized to hold the same number of media sheets as integrated media tray 14 of imaging apparatus 10 or may be sized to hold different quantities and different sizes of media sheets. A media output area 36 may be disposed in the imaging apparatus 10 in which printed media sheets are placed. Input media trays 14, 34 include respective reference edge surfaces 15, 35 that are vertically aligned with one another. Spaced apart from reference edge surfaces 15, 35 are adjustable media edge alignment members 17, 37, respectively, that are translatable as indicted by the double headed arrow to adjust for different media widths such as Legal, Letter, A4, A5, A6, and Envelope. Also provided in media input trays 14, 34 are adjustable media trailing edge alignment guides 18, 38. Lift plates 19, 39 are pivotally mounted in media input trays 14, 34 and are elevated by a motor, such as motors 92A, 92B, to raise the media 66A, 66B to pick mechanisms 57A, 57B. Alternatively, no lifts may be used and pick mechanisms 57A, 57B may be rotated down into media input trays 14, 34 to pick media sheets from the media 66A, 66B. Positioned above and aligned with reference edge surface 15 within housing 12 is an additional reference edge surface 21 that is used to guide the fed media sheet to the print engine 52. For each additional option assembly 30 added, a reference edge surface 35 provided therein would be vertically aligned with either the reference edge surface 21 of the imaging apparatus 10 above and with those of the option assemblies 30 positioned above or below it. One example embodiment of a reference edge assembly may be found in U.S. Pat. No. 8,025,283 which is incorporated by reference herein. Media input trays 14, 34 move in a direction transverse to a media feed direction.

Imaging apparatus 10 may also include a scanner portion 40 including an auto-document feeder (ADF) 42. Imaging apparatus 10 may include a user interface 44, such as a graphical user interface, for receiving user input concerning operations performed or to be performed by imaging apparatus 10, and for providing to the user information concerning the same. User interface 44 may include a display panel 46, which may be a touch screen display in which user input may be provided by the user touching or otherwise making contact with graphic user icons in the display panel 46. Display panel 46 may be sized for providing graphic images that allow for convenient communication of information between imaging apparatus 10 and the user. In addition or in the alternative, input keys 48 may be provided to receive user input.

FIG. 2 is a schematic illustration of imaging apparatus 10. Imaging apparatus 10 includes a controller 50 communicatively coupled to a print engine 52 and sheet feed system, generally designated 54. Two sheet feed systems 54A, 54B are illustrated, one in input media tray 14 of imaging apparatus 10 and input media tray 34 of option assembly 30, respectively. Sheet feed system 54A is slidably supported by plate 23 while sheet feed system 54B is supported by the top 163 of housing 32 (See FIG. 6). Controller 50 includes a processor unit 55 and an associated memory 56, and may be formed as one or more Application Specific Integrated Circuits (ASICs). Memory 56 may be any volatile or non-volatile memory or combination thereof such as, for example, random access memory (RAM), read only memory (ROM), flash memory and/or non-volatile RAM (NVRAM). Alternatively, memory 56 may be in the form of a separate electronic memory (e.g., RAM, ROM, and/or NVRAM), a hard drive, a CD or DVD drive, or any memory device convenient for use with controller 50. The user interface 44 may include firmware maintained in memory 56 within housing 12 which may be performed by controller 50 or another processing element.

Controller 50 serves to process print data and to operate print engine 52 during printing of an image onto a sheet of media. Print engine 52 may include any of a variety of different types of printing mechanisms including dye-sublimation, dot-matrix, ink-jet or laser printing.

Imaging apparatus 10 has a media path 60 through which media sheets travel in a media feed direction, as indicated generally by arrow 62. A plurality of pairs of rollers, such as rollers 64 and 65 may be disposed within imaging apparatus 10 along media path 60 and a media path extension 67, respectively, for guiding a picked media sheet from a stack of media sheets 66A in the media input tray 14 through media path 60, or a stack of media sheets 66B in media input tray 34 of option assembly 30 through media path extension 67 and into media path 60, moving the picked media sheet to a location adjacent print engine 52 for printing an image thereon and then moving the picked media sheet having the printed image to media output area 36. Feed rollers 65 may also be provided within the option housing 30 or input media tray 34 to feed media from a lower positioned option housing to a higher positioned option housing or to the imaging apparatus. The media path 60, media path extension 67, or an auxiliary media path 70 may be configured as an L-shaped media path, a C-shaped media feed path, a straight-through feed path or other media feed path configuration known in the art. Further, media sheets may be manually loaded by an operator via front panel 20 into the MPF 16. Associated roller pair 68 located in the front portion 18 of input media tray 14 receives a media sheet from MPF 16 and moves the media sheet along auxiliary media path 70 and into media path 60. Controller 50 is used to control the operation of roller pairs 64, 65, 68 to coordinate movement of media sheets along media path 60, media path extension 67 and auxiliary media path 70 and to coordinate the operation of sheet feed systems 54A, 54B.

Each sheet feed system 54A, 54B includes a pick arm 80A, 80B mounting a pick roller (or pick rollers) 82A, 82B which rests on topmost media sheet 84A, 84B of media stack 66A, 66B in input media tray 14, 34, respectively. Pick roller 82A, 82B rotates in a direction indicated by arrow 86 to move media sheet 84A, 84B into a media dam 88A, 88B located within input media trays, 14, 34, and ultimately into media path 60. In an example embodiment, pick arm 80A, 80B of sheet feed system 54A, 54B may be an auto compensating pick module (ACM) having a drive train (not shown) encased therein for transmitting from drive shafts 90A, 90B both a rotational force and a downward force to pick rollers 82A, 82B, respectively. Drive shafts 90A, 90B are mechanically coupled to drive motors 92A, 92B under the control of controller 50. The drive train may include a plurality of gears, pulleys, belts or the like for transferring rotational power from the drive motor to pick roller 82. Drive motors 92A, 92B may be a D.C. motor forming part of the sheet feed systems 54A, 54B or may be in the form of a separate motor which is coupled to sheet feed systems 54A, 54B using a transmission and clutch (not shown) or the like.

Figure 3:
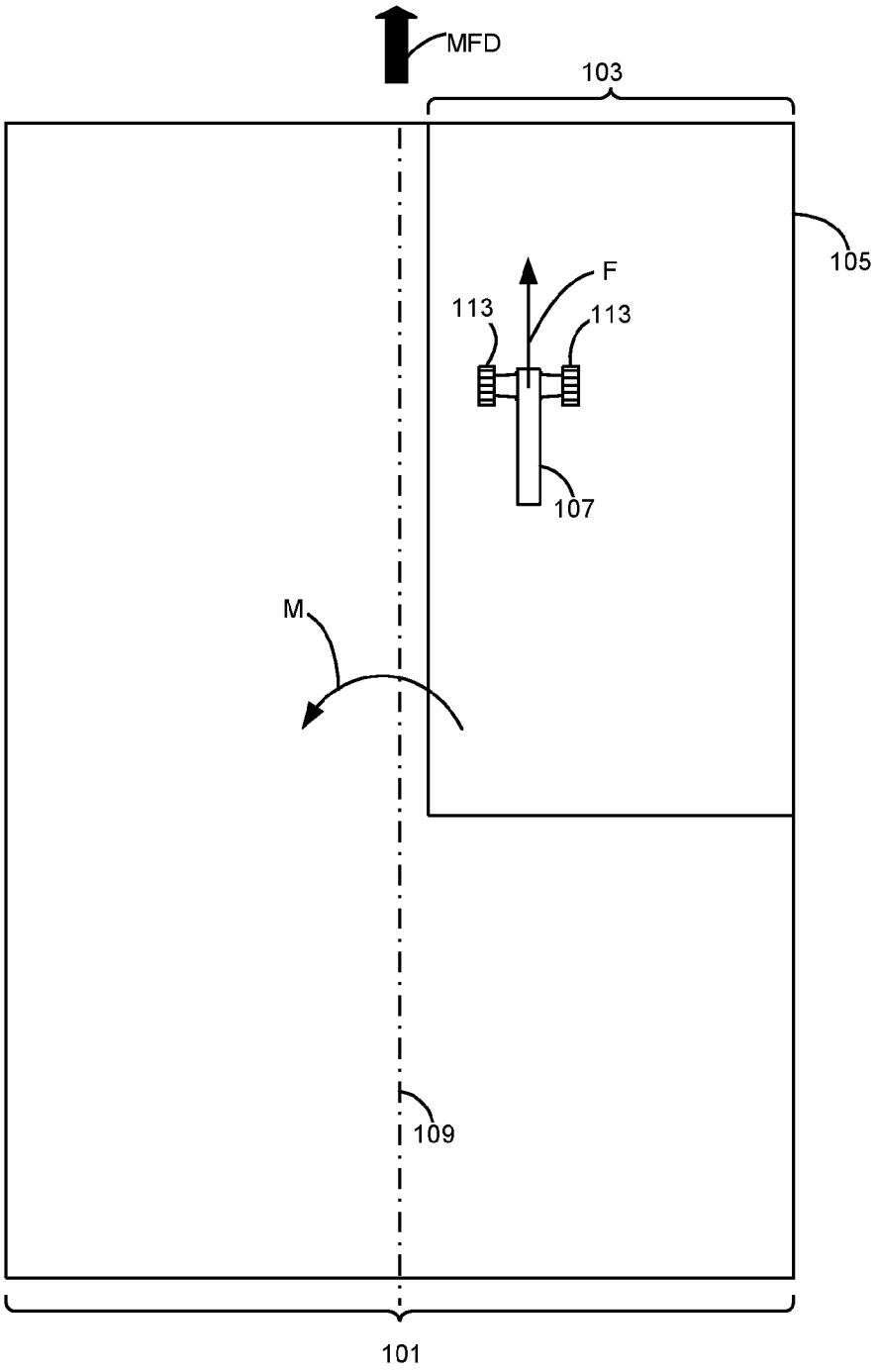
FIGURE 3 PRIOR ART
FIG. 3 is an illustrative view of a traditional pick arm position on a media sheet in prior art reference edge type systems.

In prior art reference edge type systems as depicted in FIG. 3, a stack of widest supported media 101 and a stack of narrowest supported media 103 may be positioned within a media tray towards a reference edge 105 thereof. As shown, a pick arm 107 is disposed at a fixed position across the media sheet that is laterally offset toward the reference edge 105 from a centerline 109 of the media tray and which aligns with the centerline of the widest supported media 101 such that two pick rollers 113 contact a topmost sheet for both the stack of widest supported media 101 and the stack of narrowest supported media 103. While this prior art arrangement generally ensures reliable sheet picking operation for both the widest and narrowest supported media, pick reliability of the widest supported media is compromised. For the widest supported media 101, when pick force F are applied to the topmost sheet to move the topmost sheet in the media feed direction (MFD) indicated by arrow MFD, the laterally offset arrangement of the pick arm 107 creates a moment M about the center of gravity of the topmost media sheet of the stack that induces skewing of the topmost sheet upon feeding into the imaging apparatus, thereby increasing the probability of paper jams. The moment M would be largest for the widest supported media as the lateral offset is largest for the widest supported media. To improve feed reliability in reference edge type systems, it is desired that the media pick forces be substantially balanced about the centerline of a media sheet to be picked regardless of media width.

Figure 4:
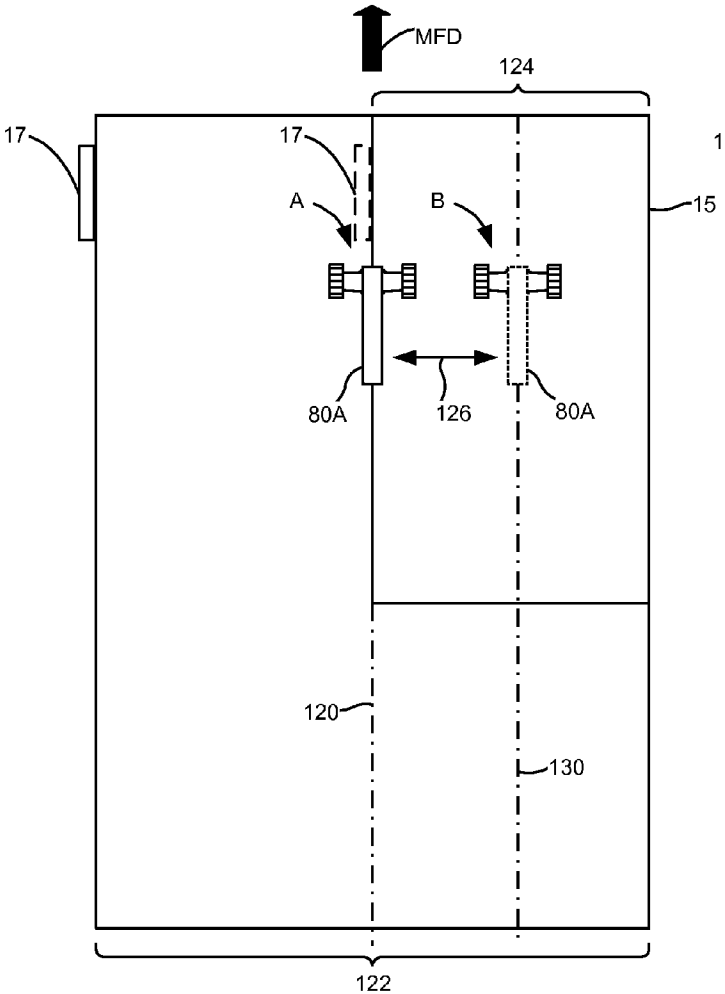
FIG. 4 is an example embodiment illustrating a pick arm that translates between two positions.

In accordance with example embodiments of the present disclosure, sheet feed system 54 includes mechanisms that automatically translate pick arm 80 in a direction transverse to the media feed direction indicated by arrow MFD during insertion of integrated input media tray 14 or removable media input tray 34 into openings 13, 33 of housing 12 of imaging apparatus 10 or housing 32 of option assembly 30, respectively, to suitably position pick arm 80 to a predetermined position in the media tray with respect to the reference edge surfaces 15, 35 so as minimize any skewing forces on the topmost sheet of the stack being picked. In an example embodiment, pick arm 80A may be movable between two predetermined pick positions A and B with respect to the reference edge surface, as shown in FIG. 4 for media tray 14. In particular, pick arm 80A may be positioned to a selected predetermined position between an adjustable edge alignment guide 17 and the reference edge surface 15. Position A located about the centerline 120 of media tray 14 would be used for a wide media 122 which may be, for example, A4, Letter, or Legal and would be located approximately about the centerline of such wide media or about 105 mm from reference edge surface 15. If a narrow media 124, such as an A5 media, is to be picked by pick arm 80A, edge alignment guide 17 would be moved, translating pick arm 80A to predetermined position B spaced away from reference edge surface 15 at about 74 mm from reference edge surface 15 which would be approximately at a centerline 130 of the narrow media 124.

Figure 5:
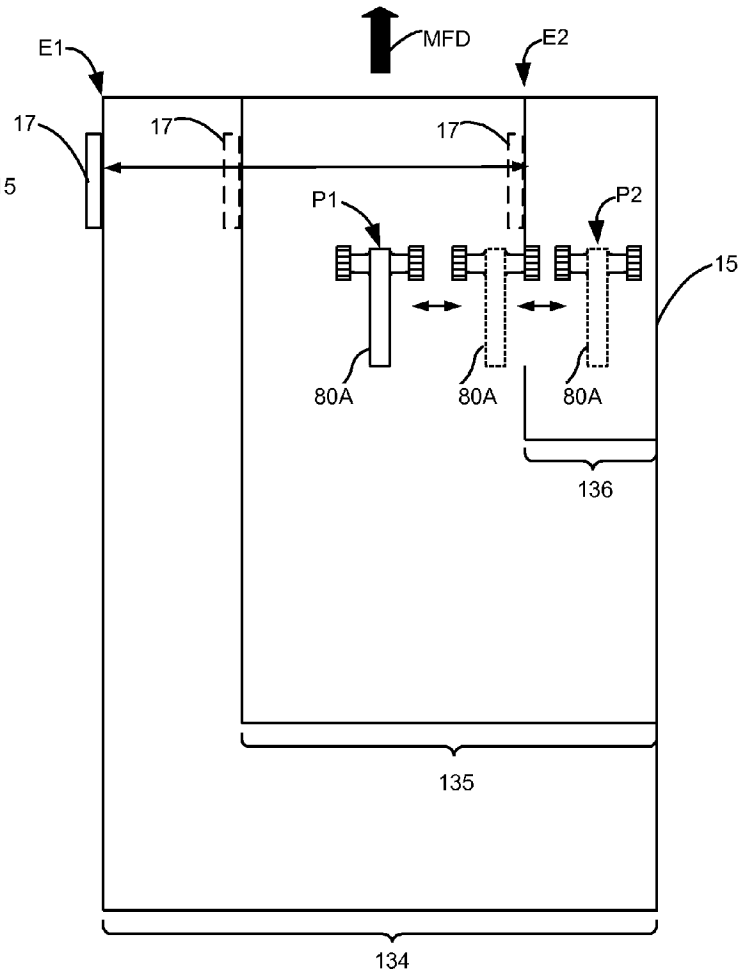
FIG. 5 is an example embodiment illustrating a pick arm that translates between multiple positions.

In another example embodiment, as shown in FIG. 5, pick arm 80A is illustrated as being movable anywhere between two predetermined end positions P1, P2 that correlate with the two end positions E1, E2 for edge alignment guide 17 in a direction transverse to the media feed direction indicated by arrow MFD to accommodate a multiplicity of media sizes. For a media input tray designed for Letter-sized media or narrower, end position E1 would be approximately 216 mm from reference edge surface 15. For a media input tray designed for Ledger-sized media or narrower media, end position E1 would be about 280 mm from reference edge surface 15. For either of these media trays, if envelope-sized media was the narrowest media to be used, end position E2 would be about 44 mm from reference edge surface 15. Three media sizes 134, 135 and 136 are illustrated with media size 134 being the widest and then decreasing in width through media sizes 135 and 136. The pick arm 80A translates approximately ½ of the distance that the edge alignment guide 17 translates so that the pick arm 80A will be approximately centered between the edge alignment guide 17 and reference edge surface 15. This in turn places the pick arm 80A approximately at the centerline of the media positioned between the edge alignment guide 17 and reference edge surface 15. Pick arm 80B of sheet feed system 54B operates in a similar manner in media input tray 34.

Figure 6:
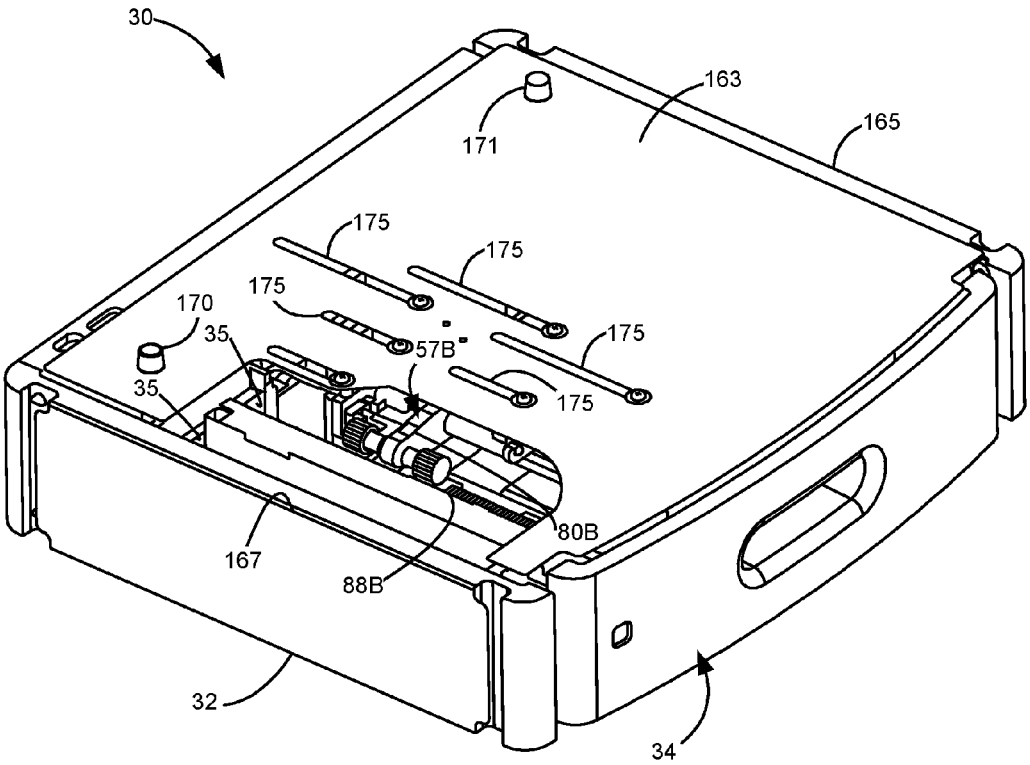
FIG. 6 is a perspective view of an option assembly having a sheet feed system and removable media tray of the imaging apparatus in FIG. 1.
Figure 7:
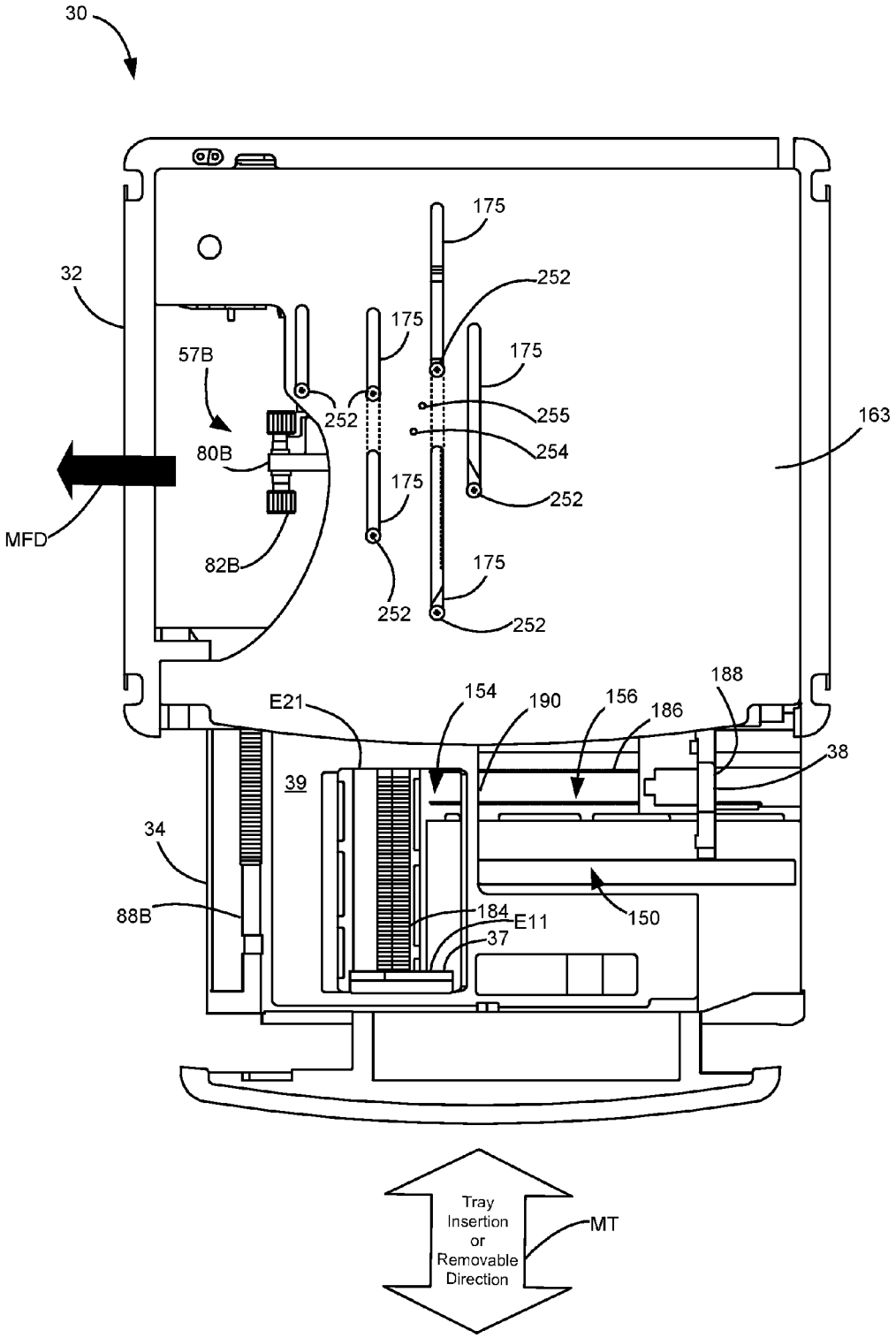
FIG. 7 illustrates a partial cutaway top view of the option assembly in FIG. 6 with a media input tray partially removed from a housing of the option assembly.

FIGS. 6-7 illustrate option assembly 30 comprising removable media input 315 tray 34 defining a media storage location 150, housing 32 in which media input tray 34 is placed, and sheet feed system 54B including pick mechanism 57B. Housing 32 includes a top platform or plate 163 fastened to side walls 165, 167 by fasteners such as screws (not shown) by welding, or which may be integrally formed as a single piece. Alignment posts 170, 171 extend vertically from housing 32 and through top plate 163 and are received into corresponding alignment holes (not shown) in the unit above it, which is either imaging apparatus 10 or another option assembly 30, to maintain proper alignment of the reference edge surfaces and the media path 60 and media extensions 67. Top plate 163 includes a plurality of parallel elongated slots, generally designated 175, for supporting features that facilitate translation of pick mechanism 57B transverse the media feed direction, as will be explained in greater detail below. As illustrated reference edge surface 35 is positioned adjacent one end of the media dam 88B and is in a mechanically fixed position in relation to alignment post 170.

FIG. 7 illustrates a top view of option assembly 30 with media input tray 34 partially removed from housing 32. As indicated by the double headed arrow MT, media input tray 34 moves in a direction transverse to a media feed direction indicated by the arrow MFD on the left of the figure. As shown, media input tray 34 includes edge alignment guides 37, 38 for the media that are adjustable and lockable within tracks 184, 186, respectively, to accommodate various lengths and widths of media disposed in media storage location 150. The tracks 184, 186 set a predetermined range of travel for edge alignment guides 37, 38. Track 184 is transverse to the media feed direction while track 186 is parallel to the media feed direction. Edge alignment guide 37 is spaced apart and opposite to reference edge surface 35 while edge alignment guide 38 is spaced apart and opposite media dam 88B. Track 186 allows edge alignment guide 38 to move between a distal position 188 and a proximal position 190 (in relation to the trailing edge of the media) and abut the trailing edges of media disposed within the media storage location 150. Track 184 allows edge alignment guide 37 to be continuously movable between a first end position E11 and second position E21 both positioned at predetermined positions from the reference edge surface 35 as previously described for end position E1, E2 in media input tray 14. Edge alignment guide 37 prevents media from moving transverse the media feed path and serves as an edge guide that guides media along the media path as the media is fed. The range of adjustment for edge alignment guide 37 may be substantially the same, less than or greater than that of edge alignment guide 17 depending upon the media desired to be used. In one example embodiment, the range of travel of edge alignment guide 37 may have a maximum extent approximately equal to the width of media input tray 34 and a minimum extent approximately 8 cm from the reference edge surface 35 of media input tray 34. Provided within media storage location 150 is a lift plate 39 that is pivotally mounted and used to elevate the media stack to bring the top-most media sheet up to the pick rollers 82B. Lift plate 39 has a first cutout 154 to accommodate the movement of edge alignment guide 37 along track 184 and a second cutout 156 to accommodate the movement of edge alignment guide 38 along track 186. A similar lift plate may be provided in input media tray 14.

Figure 8:
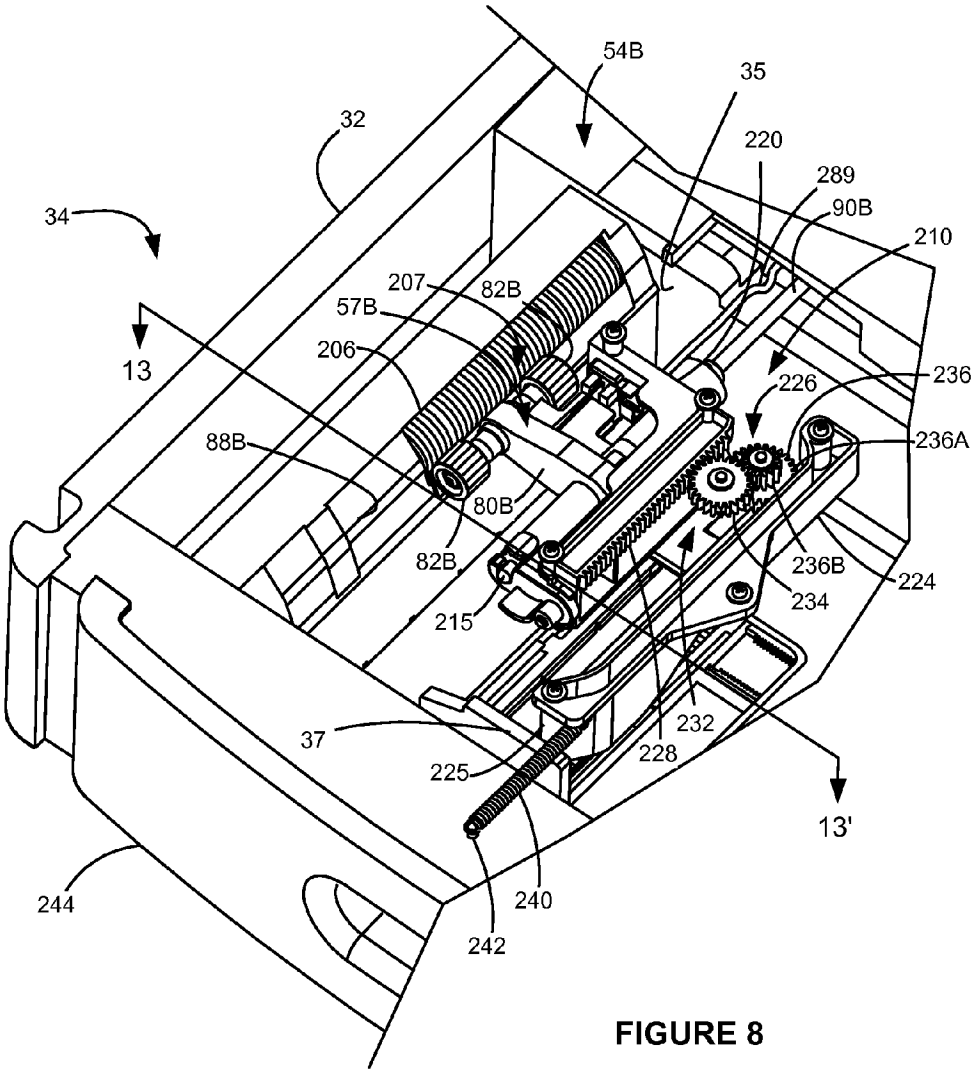
FIG. 8 is a partial perspective view of a media input tray illustrating a sheet feed system of the option assembly shown in FIG. 6 including a pick mechanism and a translating mechanism.
Figure 9:
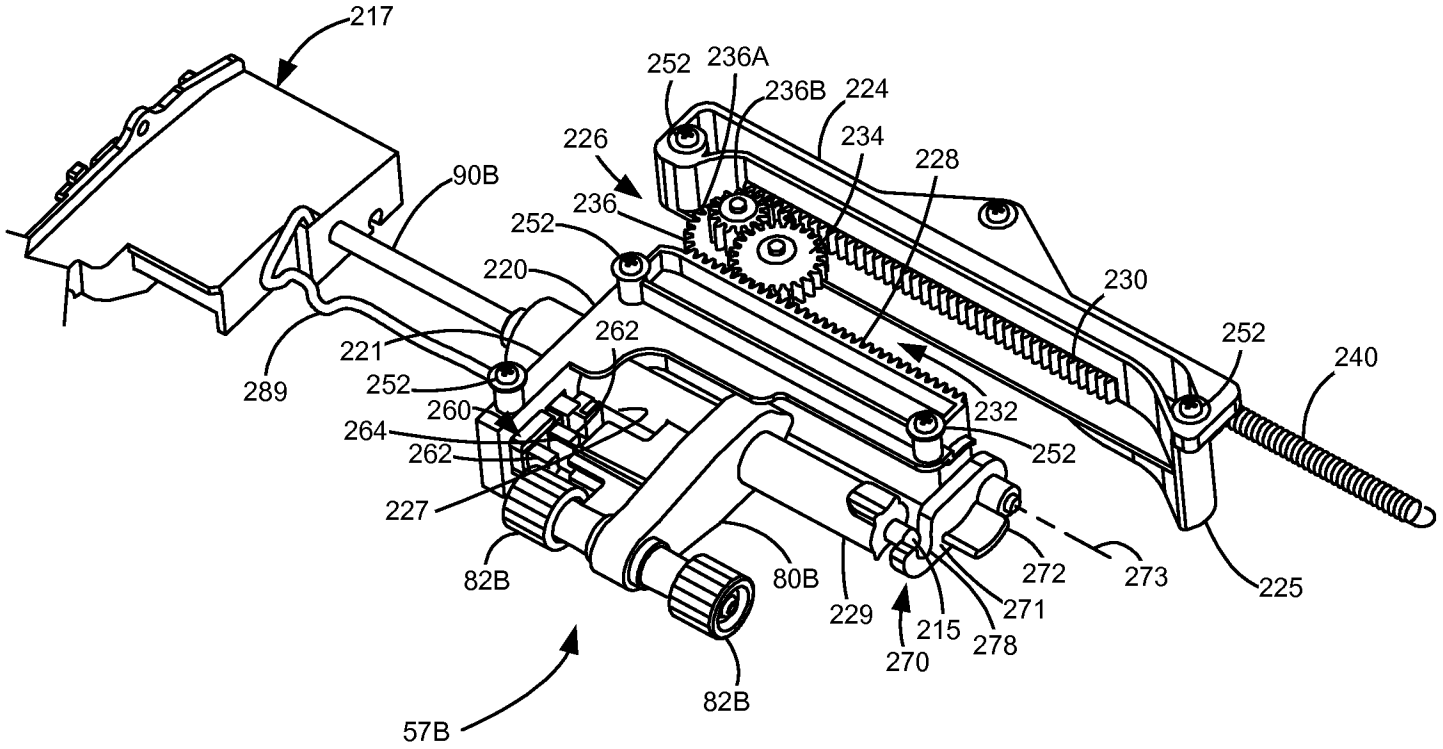
FIG. 9 is a perspective view of the sheet feed system including the translating mechanism shown in FIG. 8.
Figure 10:
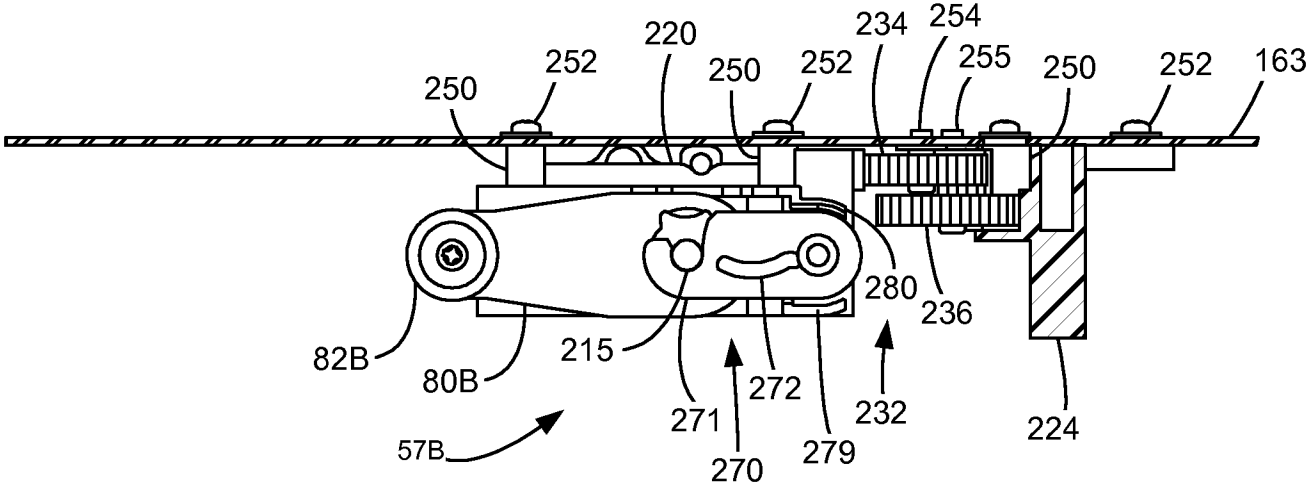
FIG. 10 is a side view of the sheet feed system shown attached to the support plate in the option assembly.

Referring to FIGS. 8-10, sheet feed system 54B of option assembly 30 is shown in further detail. As shown, sheet feed system 54B includes pick mechanism 57B and a translating mechanism 210. The pick mechanism 57B includes a pick arm 80B removably mounted on drive shaft 90B at one end and to a pair of pick rollers 82B rotatably mounted on the other end for picking a topmost media sheet from a stack of media in media input tray 34. Pick arm 80B houses a transmission that transmits torque from drive shaft 90B to pick rollers 82B. The translating mechanism 210 automatically adjusts the position of pick mechanism 57B between multiple positions laterally or orthogonally across the media sheet stack to position pick mechanism 57B approximately equidistant between the reference edge surface 35 and edge alignment guide 37 after insertion of media input tray 34 into housing 32. Sheet feed system 54B may also include a separator roller 206 positioned downstream in the media feed direction of the pair of pick rollers 82B for receiving a media sheet picked by pick rollers 82B. The spacing between the surfaces of the pick rollers 82B and separator roller 206 may be about 10 mm and may be termed an "open nip". Separator roller 206 helps to separate double fed sheets where the topmost sheet and following sheet are picked together by stopping the following sheet while allowing the topmost sheet to continue on. As shown, separator roller 206 is transversely mounted in media dam 88B where a portion of separator roller 206 projects outwardly from the surface of media dam 88B through an opening 207 therein. In one example embodiment as illustrated, separator roller 206 may continuously extend at a length that accommodates a full range of translation of pick mechanism 57B along the pick drive shaft 90B. In this way, pick rollers 82B may remain aligned with a portion of separator roller 206 when pick mechanism 57B is translated by translation mechanism 210 to a given position along pick drive shaft 90B based on the selected position of edge alignment guide 37 and across the media sheet stack disposed within media storage location 150.

As shown, pick arm 80B is slidably mounted on pick drive shaft 90B which is a cantilevered shaft having a free end 215. Pick drive shaft 90B is connected to and supported by a drive mechanism 217 which is mounted within housing 32 of option assembly 30. Translating mechanism 210 includes a carriage 220 which is movable substantially parallel to pick drive shaft 90B and slidably coupled with at least a portion of pick arm 80B. In the example shown, carriage 220 is coupled to pick arm 80B on pick drive shaft 90B. Carriage 220 includes an extension arm 221 and a latch 270 at opposite sides thereof that are slidably coupled to pick drive shaft 90B while allowing pick drive shaft 90B to be freely rotated. Journals 227, 229 extending from both sides of pick arm 80B are positioned abuttingly between extension arm 221 and latch 270 of carriage 220 such that shifting carriage 220 parallel to pick shaft 90B causes pick arm 80B to also translate along shaft 90B while still allowing pick arm 80B to be rotated by drive shaft 90B. Carriage 220 is slidably supported by top plate 163 so that its weight is not carried by drive shaft 90B. Such an arrangement prevents pick arm 80B from being influenced by external forces that may act on carriage 220 and be transferred to pick arm 80B during picking of the topmost media sheet by pick rollers 82B.

Translating mechanism 210 further includes an actuator member 224 adjacent carriage 220. Actuator member 224 is operatively coupled to carriage 220 via a coupling mechanism 226. In one example embodiment, carriage 220 and actuator member 224 includes gear racks 228, 230, respectively, and coupling mechanism 226 includes a gear mechanism or gear train 232 comprising an idler gear 234 and a compound gear 236 that mesh with gear racks 228, 230 of carriage 220 and actuator member 224, respectively. Compound gear 236 comprises at least two different diameter gears, such as first gear 236A and second gear 236B, that are fixedly attached to each other and rotate together at the same direction and speed. First gear 236A is shown having a larger diameter than second gear 236B. As illustrated, first gear 236A of compound gear 236 meshes with gear rack 230 of actuator member 224. Idler gear 234 is inserted between second gear 236B of compound gear 236 and gear rack 228 of carriage 220, and meshes therewith. In the example embodiment shown, gear train 232 may have a gear ratio of 2:1 such that for a given movement of actuator member 224 causes carriage 220 to move substantially half as far as actuator member 224 moves. In this way, carriage 220 translates substantially one half a distance traveled by actuator member 224 positioning pick arm 80B approximately equidistant between reference edge surface 35 and edge alignment guide 37 which would also place the pick mechanism 57B at about the centerline of any media positioned between reference edge surface 35 and edge alignment guide 37. Other gear ratios may be used to achieve a different positioning location for pick arm 80B between edge alignment guide 37 and reference edge surface 35. Although coupling mechanism 226 has been described as a gear train, it will be appreciated that other coupling mechanisms may be utilized.

Actuator member 224 is positioned to be engageable at end 225 by edge alignment guide 37 during insertion of media input tray 34 into housing 32 and thereafter. A return spring 240 elastically connects actuator member 224 to a pin 242 located on front portion 244 of housing 32. Return spring 240 continuously biases actuator member 224 in a direction toward edge alignment guide 37 to its home position shown in FIG. 8, where it causes carriage 220 to position pick arm 80B substantially equidistant between reference 425 edge surface 35 and edge alignment guide 37 about a centerline of media support area 150.

In one example embodiment, carriage 220, actuator member 224, and gear train 232 are slidably supported by top plate 163. As shown in FIGS. 7 and 10, carriage 220 and actuator member 224 may include a plurality of bosses 250 extending upwardly therefrom which are received in corresponding elongated parallel slots 175 provided on top plate 163. Fasteners, such as screws 252, may be mated with corresponding bosses 250 to movably anchor and secure carriage 220 and actuator member 224 to top plate 163. Idler gear 234 and compound gear 236 may have corresponding axles 254, 255 secured to top plate 163. In other alternative embodiments, other suitable means of supporting carriage 220, actuator member 224, and gear train 232 may be used. For example, a frame (such as plate 23 in FIG. 2) which may be separate from top plate 163 may be disposed adjacent and/or above carriage 220, actuator member 224, and gear train 232 to provide support. Elongated slots 175 may also be provided in other forms such as, for example, by using rails that are mounted on a bottom surface of top plate 163 and each boss 250 may be designed to include a head engaging a corresponding slot provided on top plate 163 to suspend carriage 220 and actuator member 224 above media input tray 34. Individual elongated slots 175 may be provided for each boss 250 or two slots may be joined together as indicated by the dashed lines in FIG. 7 where the bosses travel along the same line.

Figure 11:
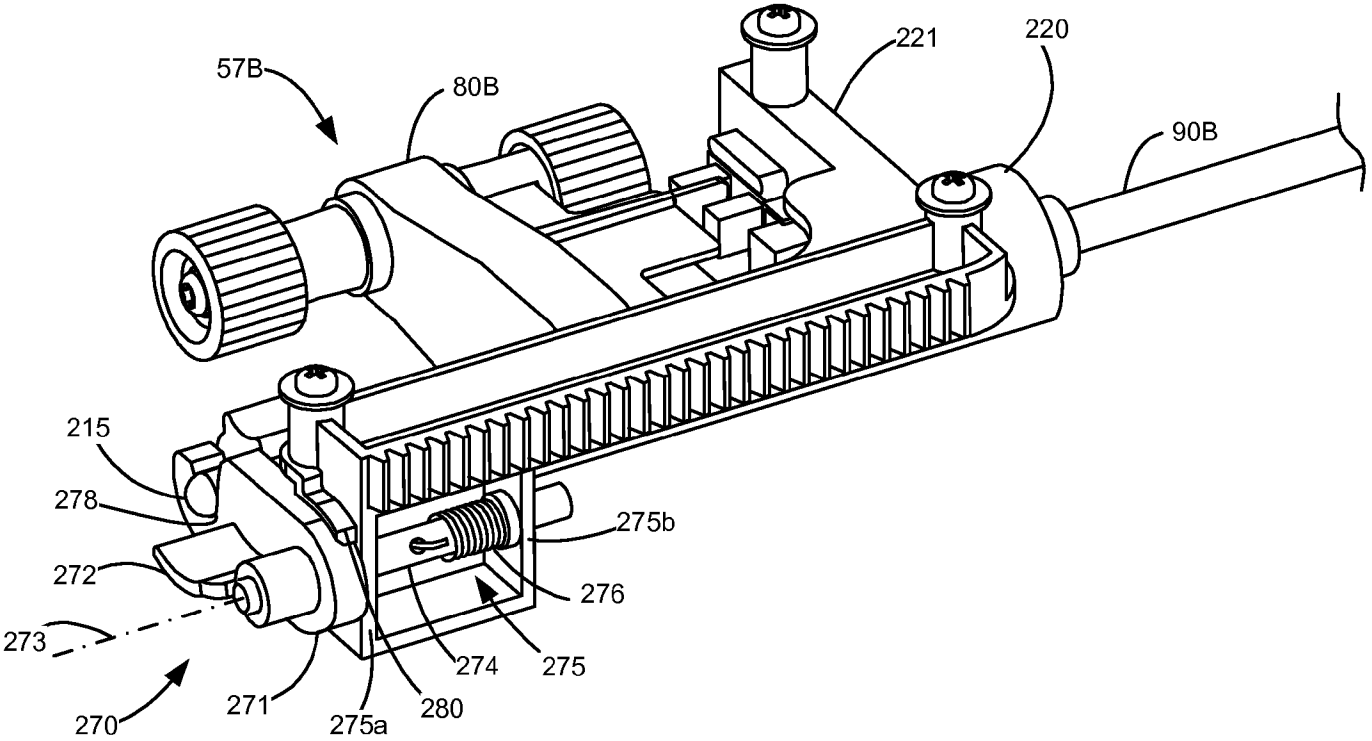
FIG. 11 is a rear perspective view of the carrier of the translating mechanism showing the latch assembly of the translating mechanism.

Pick arm 80B is removable from pick drive shaft 213 using latch 270. Latch 270 may include a latch arm 271 pivotally mounted about a pivot axis 273 for engaging the free end 215 of cantilevered pick drive shaft 90B so as to retain pick arm 80B on shaft 90B. In an example mounting configuration of latch 270 on carriage 220 shown in FIG. 11, a stud 274 defining pivot axis 273 extends from latch arm 271 and through walls 275*a*, 275*b* of a hollow portion 275 at a rear of carriage 220. Within the hollow portion 275, a biasing spring 276 resiliently attaches stud 274 to wall 275*b* to thereby continuously urge latch arm 271 towards carriage 220. Latch arm 271 includes a recess 278 at its distal end. In a latched position as shown in FIG. 9, latch arm 271 engages free end 215 of shaft 90B with the recess 278 receiving free end 215. Alternatively, free end 215 may be received by a hole (not shown) formed on latch arm 271. Latch arm 271 is prevented from rotating about pivot axis 273 by retaining members 279, 280 protruding from a side of carriage 220. Accordingly, pick arm 80B is retained on shaft 90B.

Figure 12A:
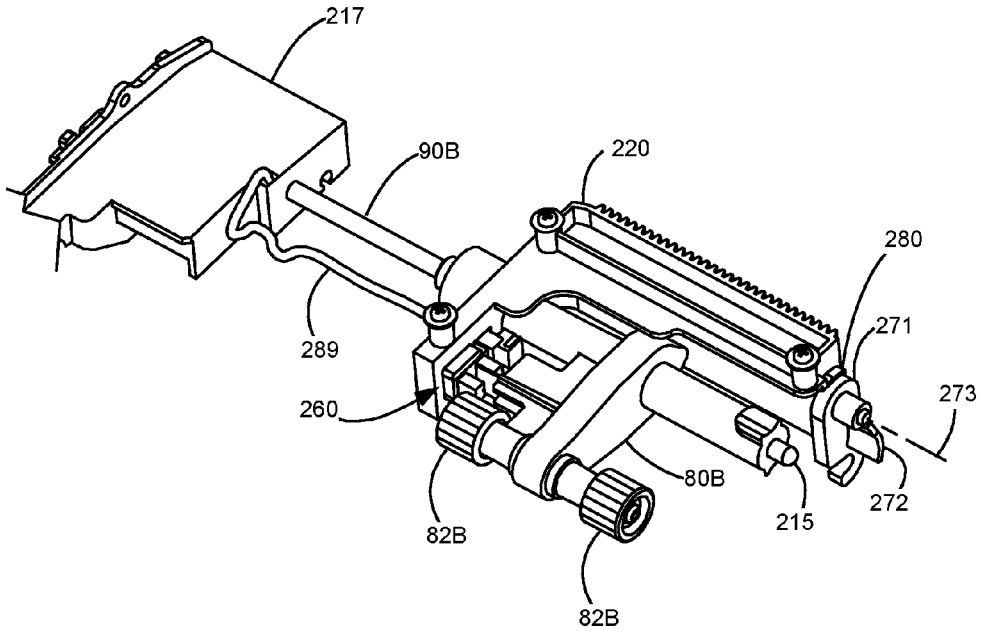
Figure 12B:
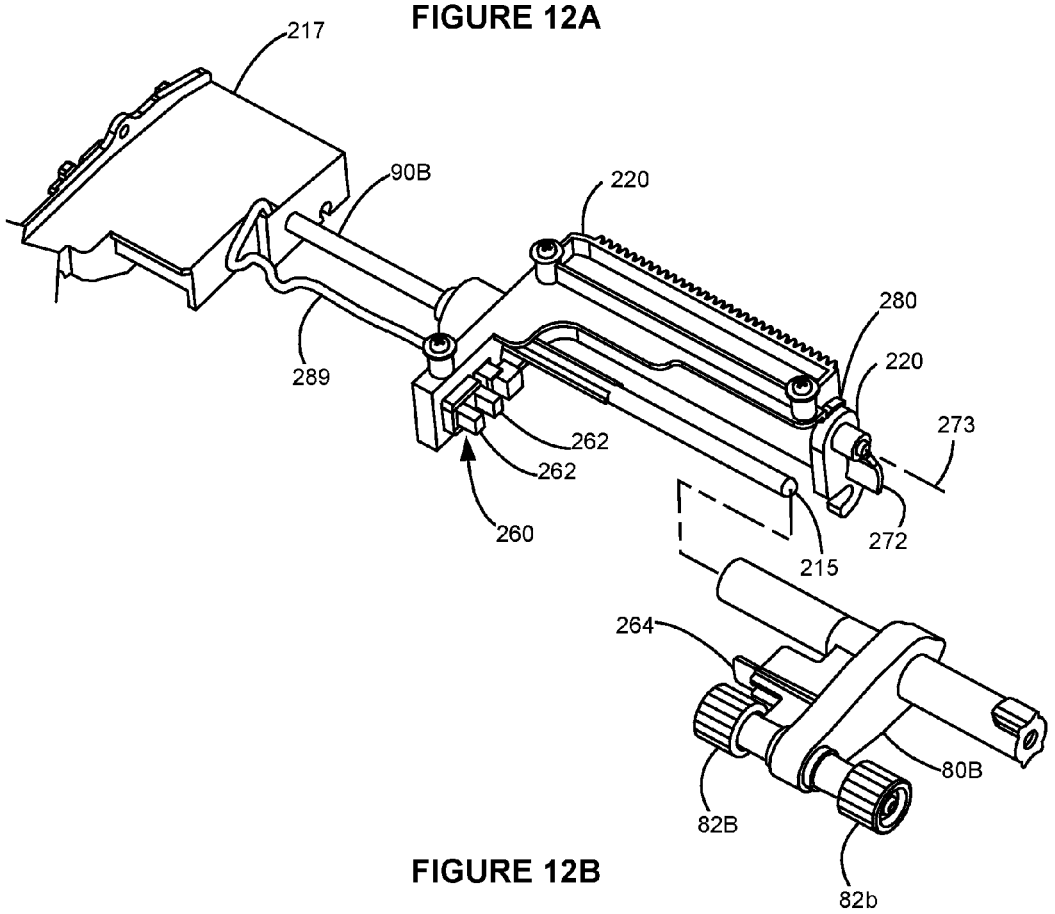
FIG. 12B is a perspective view illustrating the pick mechanism removed from the translating mechanism.

A tab 272 extends from a side of latch arm 271 and is positioned to receive force from a user for disengaging latch arm 271 from free end 215 of shaft 90B. In particular, the user may pull latch arm 271 away from carriage 220 against the force of biasing spring 276 to release latch arm 271 from the constraints of restraining members 279, 280. Once released, the user may freely rotate latch arm 271 about pivot axis 273, e.g., in the counter-clockwise direction, to an unlatched position, as shown in FIG. 12A. When latch arm 271 is in the unlatched position, pick arm 80B can be slid off of drive shaft 90B for replacement and, conversely, into position on drive shaft 90B during installation, as shown in FIG. 12B. The user may return latch 270 back to its latched position after installation by rotating latch arm 271 using tab 272, e.g., in the clockwise direction, until latch arm 271 is retracted back by biasing spring 276 into a restrained position between restraining members 279, 280.

Figure 13:
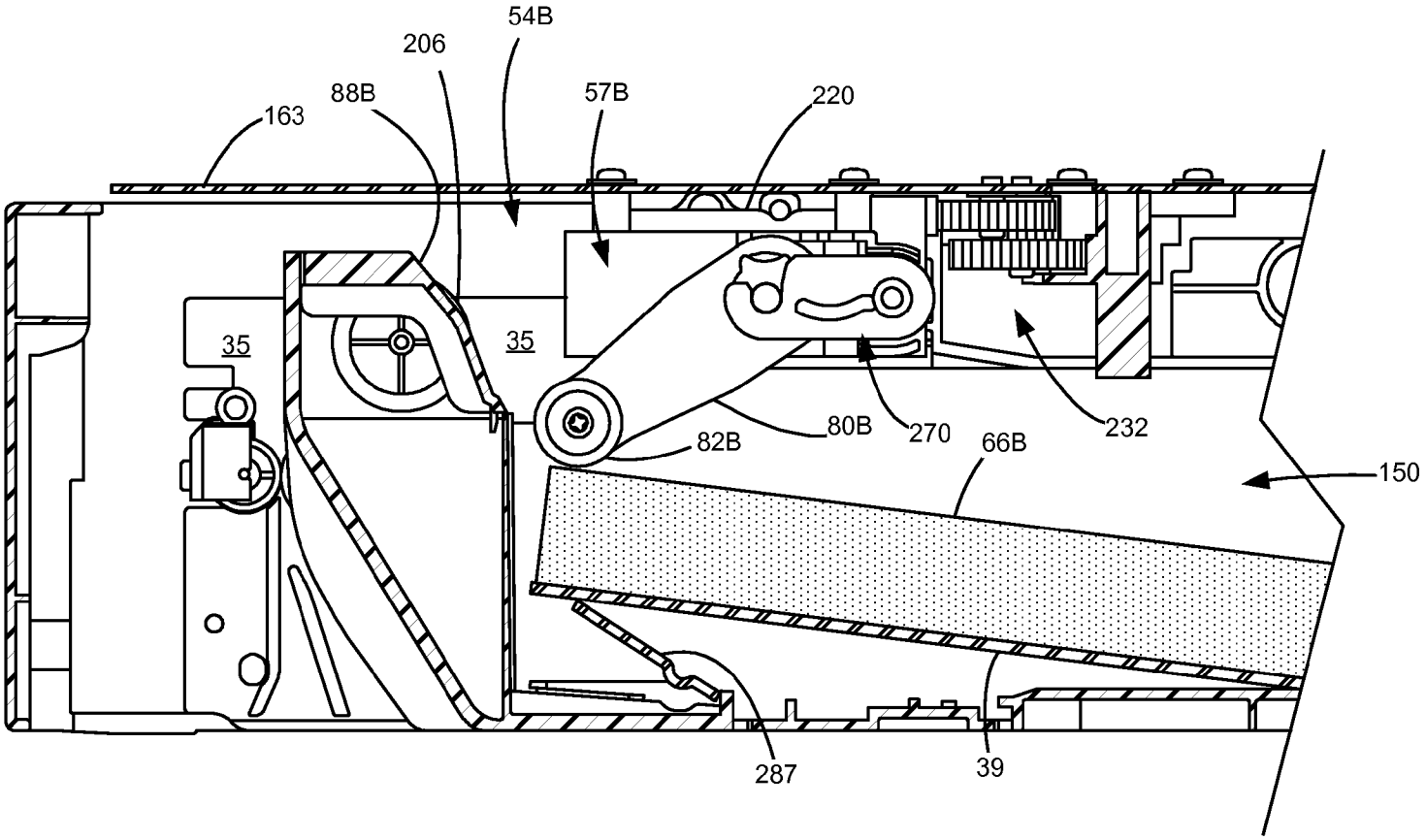
FIG. 13 is a partial sectional view taken along line 13-13' of FIG. 8 illustrating a media stack elevated within a media storage location by a lift plate to contact pick rollers of the pick mechanism.

Referring to FIGS. 9, 12A, 12BA and 13, a stack height sensor, such as an index sensor 260, may be mounted on carriage 220 adjacent to pick arm 80B for sensing an angular position of pick arm 80B that corresponds to a height of media sheets disposed in the media storage location 150. In the example embodiment illustrated, index sensor 260 is an optical sensor having an optical path between a pair of opposed arms 262 positioned on extension arm 221 of carriage 220. If the optical path of index sensor 260 is unblocked by an index flag 264 extending from a side of pick arm 80B when media input tray 34 is inserted into housing 32, media stack 283 is raised in indexed moves by lift plate 39 positioned within media storage location 150 in order to ensure that the top of the stack of media sheets is within a desired pick height, as shown in FIG. 13. A lift arm 287 positioned beneath lift plate 39 may be used to elevate lift plate 39 and media stack 66B to pick mechanism 57B for feeding into a media path. Conversely, if the optical path of index sensor 260 is blocked by index flag 264 such as shown in FIG. 9, for example, raising the media sheets is not required. Index sensor 260 may communicate with controller 50 via cabling 289. In turn, controller 50 may control the operation of lift plate 39 based on signals it receives from index sensor 260 transmitted over cabling 289. As will be appreciated, any suitable sensor may be used and reverse logic to that described above may also be implemented. Since index sensor 260 moves in conjunction with carriage 220, the span or length of cabling 289 is selected to allow cabling 289 to accommodate the full range of travel of carriage 220 along pick drive shaft 90B. Further, in order to limit the forces imparted back into carriage 220, cabling 289 may be allowed to move relatively unconstrained in a space between carriage 220 and drive mechanism 217 and slack would still be present in cabling 289 when the carriage 220 is at its farthest point from reference edge surface 35.

With reference to FIGS. 14A, 14B, 15A and 15B, the operation of translation mechanism 210 will now be described in more detail. Pick arm 80B is automatically adjustable by translation mechanism 210 between a plurality of selectable positions along shaft 90B based on the position of media edge alignment guide 37 during insertion of media input tray 34 into housing 32.

Figure 14A:
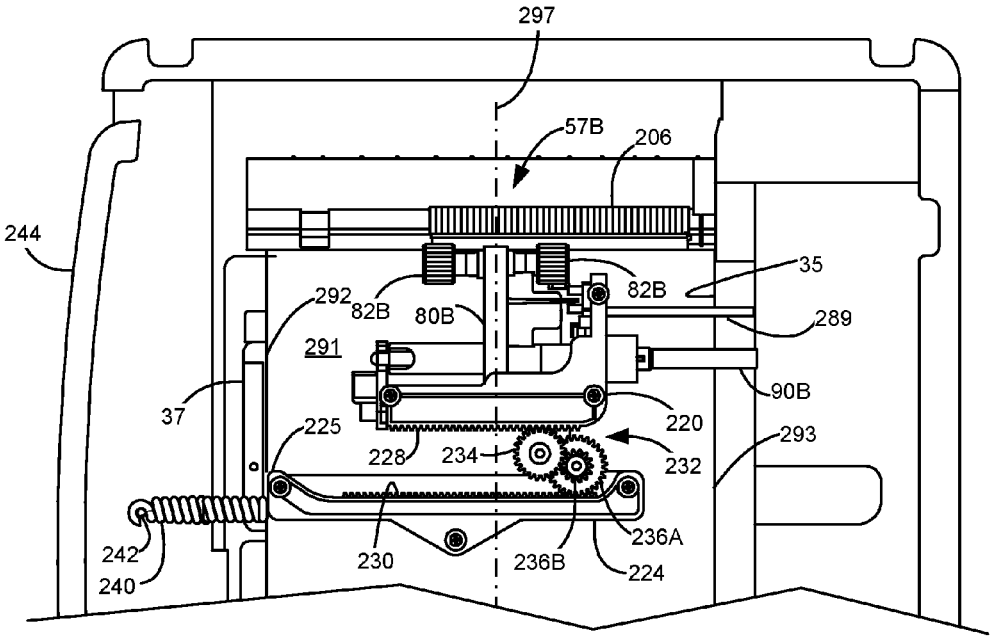
FIG. 14A is a partial plan view of the option housing and media tray with the top plate removed illustrating the pick mechanism translated by the translating mechanism to support a wide media with the top plate removed.
Figure 15A:
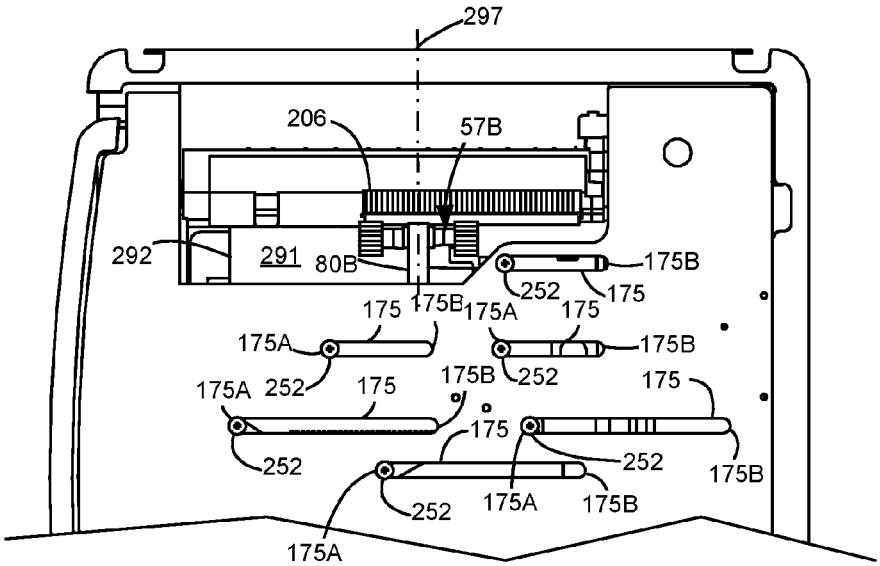
FIGS. 15A and 15B are partial plan cutaway views of the option housing illustrating the arrangements shown in FIGS. 14A and 14B, respectively, with a top plate supporting the translating mechanisms with a portion thereof cutaway to be able to view the pick mechanism.

FIGS. 14A and 15A illustrate partial top plan views of pick mechanism 57B positioned for receiving and picking a wide media, such as for example a widest supported media 291, loaded into media storage area 150 within media input tray 34. Prior to tray insertion, media edge alignment guide 37 is adjusted to be positioned against left edge 292 of media 291 to bias the right edge 293 of widest media 291 against reference edge surface 35. Actuator member 224 is initially biased in the home position by return spring 240 where the plurality of bosses 250 and screws 252 of both carriage 220 and actuator member 224 are positioned at respective slot ends 175A (left end as illustrated) of corresponding elongated slots 175. Accordingly, pick arm 80B is also positioned about centerline 297 of the media storage area 150. During media input tray 34 insertion, media edge alignment guide 37 may not make contact with end 225 of actuator member 224 so that carriage 220 and pick arm 80B are maintained in the home position for picking widest supported media 291. Following tray insertion, pick arm 80B is controlled to successively pick topmost media sheets from the stack of widest supported media 291. With pick rollers 82B being substantially evenly positioned about centerline 297 of widest supported media 291, media sheets are picked substantially without skew.

Figure 14B:
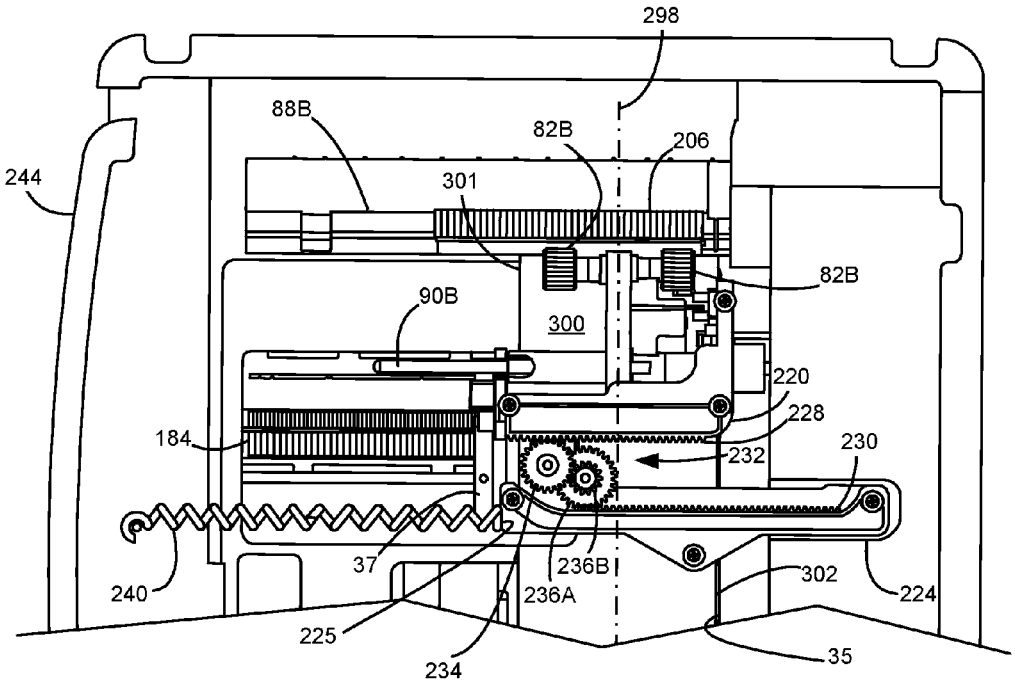
FIG. 14B is a partial plan view of the option housing and media tray with the top plate removed illustrating the pick mechanism translated by the translating mechanism to support a narrow media.
Figure 15B:
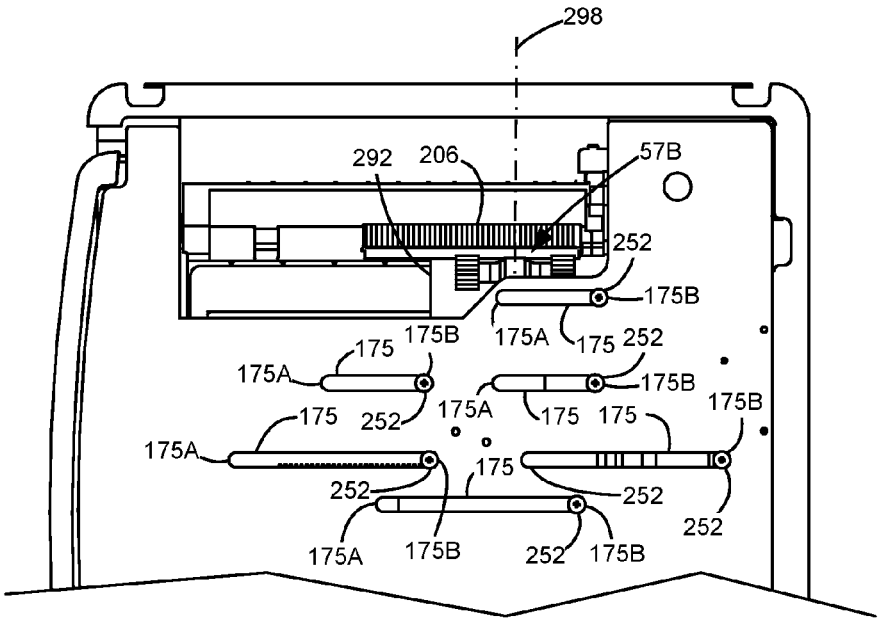

When media input tray 34 is loaded with a stack of narrow media, such as for example, a narrowest supported media 300 as shown in FIGS. 14B and 15B, media edge alignment guide 37 is adjusted along track 184 to an inner position within media input tray 34 against left edge 301 of media 300 to bias right edge 302 of narrow media 300 against reference edge surface 35. As media input tray 34 is inserted into housing 32, media edge alignment guide 37 engages and causes actuator member 224 and end 225 to move against the biasing force of return spring 240 parallel to pick drive shaft 90B. Meanwhile, compound gear 236 is rotated counter-clockwise due to meshing engagement between first gear 236A of compound gear 236 and gear rack 230 of actuator member 224. Second gear 236B of compound gear 236 also rotates counter-clockwise and causes idler gear 234 meshed therewith to rotate in a clockwise direction. As a result, gear rack 228 of carriage 220 meshed with idler gear 234 is linearly moved in the same direction substantially parallel to gear rack 230 of actuator member 224. As actuator member 224 and carriage 220 undergo linear movement as media input tray 34 is further inserted into housing 32, bosses 250 and screws 252 slide along corresponding slots 175 until settling at slot ends 175B when media input tray 34 is fully inserted into housing 32 as shown in FIG. 15B. Movement of carriage 220 causes pick arm 80B to move along shaft 90B such that pick arm 80B is nominally centered on the topmost sheet of the stack of narrowest supported media 300 about centerline 298, as shown in FIG. 14B.

Subsequently, in the event of media depletion or media replacement, media input tray 34 is removed from housing 32 to be loaded with a new stack of media. During media input tray 34 withdrawal, actuator member 224 follows with the motion of media edge alignment guide 37 due to the biasing force of return spring 240. Compound gear 236 is rotated in the clockwise direction due to meshing engagement between first gear 236A of compound gear 236 and gear rack 230 of actuator member 224. Second gear 236B of compound gear 236 also rotates clockwise and causes idler gear 234 to rotate in the counter-clockwise direction. As a result, carriage 220 having gear rack 228 meshed with idler gear 234 also linearly moves in the same direction as actuator member 224. As actuator member 224 and carriage 220 undergo movement in response to tray withdrawal, bosses 250 and screws 252 of actuator member 224 and carriage 220 travel along corresponding slots 175 until re-engaging slot ends 175A as shown in the arrangement illustrated in FIG. 14A where actuator member 225 and carriage 220 are positioned back in the home position. Accordingly, pick arm 80B is slid along pick drive shaft 90B from centerline 298 back to centerline 297.

The positions shown in FIGS. 14A, 14B, 15A and 15B, therefore define an extent or range of travel by pick mechanism 57B and pick arm 80B along shaft 90B. When, for example, an intermediate sized media sheet is loaded into media input tray 34, media edge alignment guide 37 may be adjusted accordingly and cause translation mechanism 210 to automatically position pick arm 80B about a centerline of the intermediate sized media, e.g., any position between centerlines 297 and 298, upon tray insertion. Thus, translation mechanism 210 automatically adjusts the position of pick arm 80B unbeknownst to the user inserting media input tray 34 into housing 32. All that is needed to correctly position pick arm 80B about a centerline of a loaded media sheet is for the user to adjust media alignment guide 180 in a correct position with respect to a width of the loaded media sheet prior to tray insertion.

Figure 16:
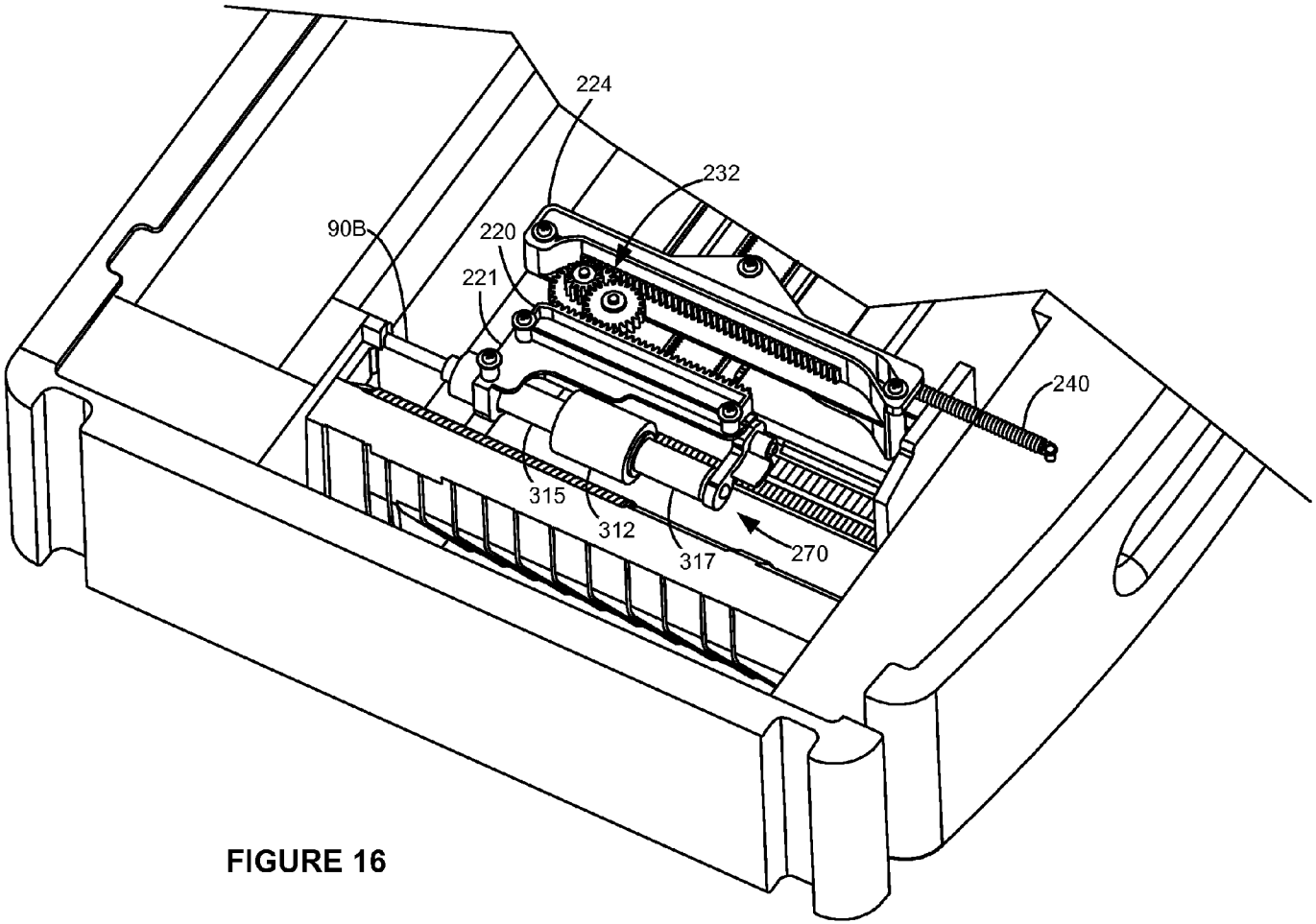
FIG. 16 is a partial perspective cutaway view of a pick mechanism having a pick roller mounted on a shaft according to another example embodiment.

In an alternative embodiment, pick mechanism 160 may include a pick roller 312 that is slidably mounted on shaft 90B as illustrated in FIG. 16. As shown, extension arm 221 and latch 270 extending at opposite sides of carriage 220 are slidably coupled to shaft 90B and enclose journals 315, 317 extending from both sides of pick roller 312 such that moving carriage 220 causes pick roller 312 to translate along shaft 90B. Pick roller 312 may also be removable from shaft 90B by using latch 270 as described above.

Figure 17:
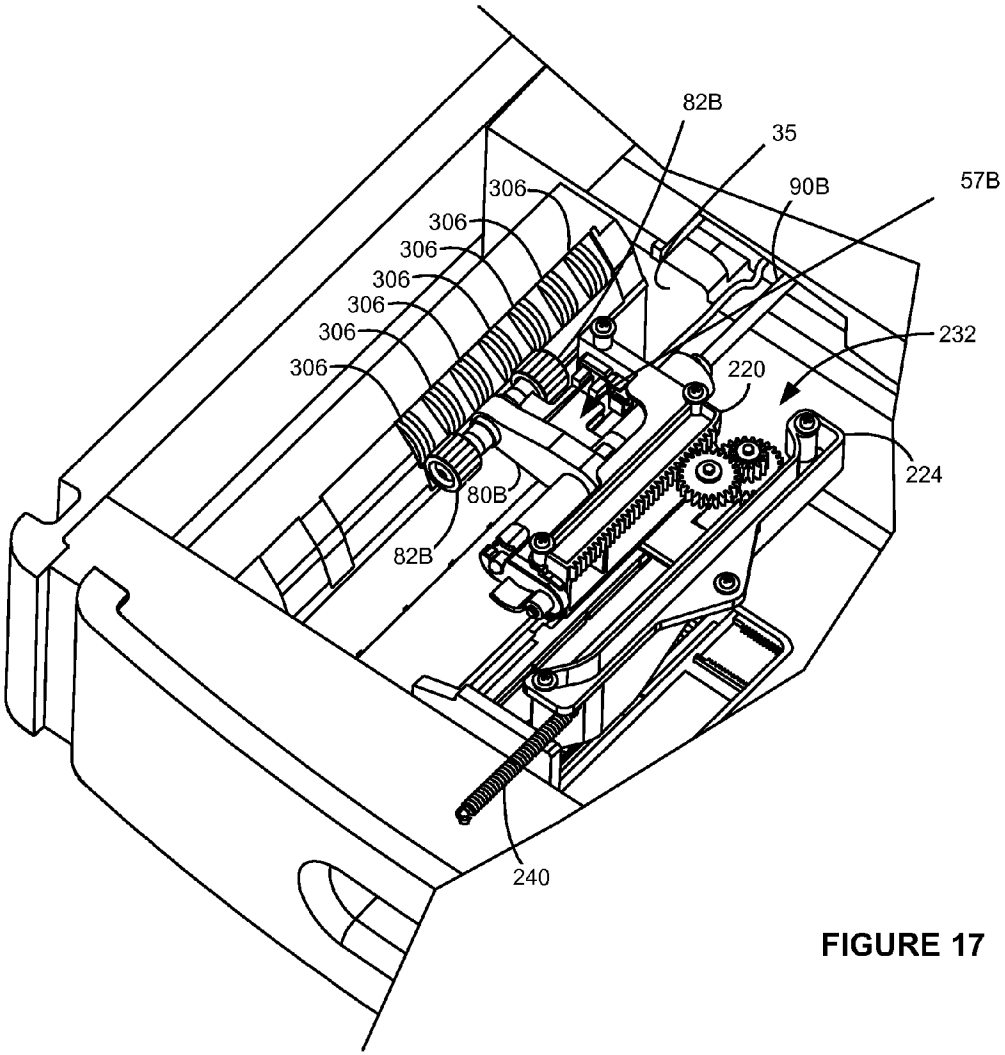
FIG. 17 is a partial perspective cutaway view of an input media tray having a media dam with a plurality of spaced apart separator rollers according to another example embodiment.

In another alternative embodiment shown in FIG. 17, a plurality of spaced apart separator rollers 306 may be arranged downstream of pick rollers 82B, relative to the media feed direction. The plurality of separator rollers 306 may extend at a length that accommodates a full range of travel of pick arm 80B along shaft 90B. The size of each separator roller 306 and spacing between adjacent separator roller 306 may be selected such that each pick roller 82B overlaps with at least a portion of at least one of the separator rollers 306 when pick mechanism 57B is translated by translation mechanism 210 at a distinct position along shaft 213.

The descriptions of the details of the example embodiments have been described using the feed system of option assembly 30. However, it will be appreciated that the teachings and concepts provided herein are applicable to any paper input source such as the integrated media tray 14 of imaging apparatus 10, high capacity input trays, or other input options, or standard paper trays without departing from the scope of the present disclosure.

Further where the media tray is loaded into the imaging apparatus in a direction parallel to the media feed direction, an additional linkage and cam assembly would be employed and attached to the frame so that as the media tray with its selected media width is inserted, the edge alignment guide would engage the linkage and cam assembly to move the actuator for translating the pick mechanism to the desired centerline position between the edge alignment guide and the reference edge surface.

It should also be recognized that the edge alignment member 17, 37 may be mounted on a motor driven drive mechanism so that imaging apparatus can automatically move the edge alignment guide to the selected position appropriate for the width of the media detected within the input media tray. In one example arrangement, the media would be loaded into the media tray so that it would abut the reference edge surface with an edge sensor such as an LED transmitter and receiver used to sense the width of the media. The edge alignment guide would then be driven to the edge of the media stack translating the pick mechanism as it moves toward the media stack. In another form, a torque sensor could be used to sense either when the edge alignment guide contacts the media stack, or if the media stack was not placed against the reference edge surface, when the media stack reached the reference edge surface when being driven by the edge alignment guide into alignment with the reference edge surface.

The foregoing description of several embodiments has been presented for purposes of illustration. It is not intended to be exhaustive or to limit the invention to the precise designs disclosed, and obviously many modifications and variations may be carried out in other specific ways than those herein set forth without departing from the scope and essential characteristics of the invention. It is intended that the scope of the invention be defined by the claims appended hereto.

What is claimed is:

1. A media picking device for an imaging apparatus having a removable media input tray configured to hold a plurality of media types of different widths, the media input tray having a reference edge surface and a media edge alignment guide moveable to a selected position with respect to the reference edge surface and further moveable to an edge of one or more media sheets disposed in the media input tray to restrain the one or more media sheets between the reference edge surface and the media edge alignment guide such that a distance therebetween corresponds to a width of the one or more media sheets, the media picking device comprising:

a pick mechanism slidably mounted on a torque supplying shaft in the imaging apparatus; and a translation mechanism comprising:

a carriage coupled to a portion of the pick mechanism and slidably attached to a platform within the imaging device; and an actuator member slidably attached to the platform and operatively coupled to the carriage, the actuator member engageable and moveable by the media edge alignment guide upon insertion of the media input tray into the imaging apparatus, wherein, when the media input tray is being inserted into the imaging apparatus, the media edge alignment guide engages the actuator member to translate the carriage and the pick mechanism along the shaft so as to position the pick mechanism between the reference edge surface and the media edge alignment guide about a centerline of the width of the one or more media sheets, and further wherein the pick mechanism and the carriage translate in the same direction as the actuator member a distance that is substantially half of a distance traveled by the actuator member.

2. The media picking device of claim 1, wherein the pick mechanism includes a pick arm slidably mounted on the shaft and at least one pick roller mounted on the pick arm, the at least one pick roller drivable by the shaft to pick a topmost media sheet of the one or more media sheets disposed in the media input tray.

3. The media picking device of claim 1, wherein the translation mechanism further includes a gear mechanism rotatably mounted to the platform to operatively couple the actuator member and the carriage to each other.

4. The media picking device of claim 3, wherein the carriage includes a first gear rack and the actuator member includes a second gear rack, the first and second gear racks operatively coupled to the gear mechanism, and wherein, upon movement of the actuator member, the second gear rack rotates the gear mechanism, which moves the first gear rack moving the carriage along the shaft in the same direction that the actuator member moves.

5. The media picking device of claim 1, wherein the translation mechanism further includes a biasing member for continuously biasing the actuator member transverse a media feed direction to engage the media edge alignment guide.

6. The media picking device of claim 5, wherein the biasing member includes a return spring having a first end connected to the imaging apparatus and a second end connected to the actuator member, the return spring, when connected at the first end to the imaging apparatus, continuously biasing the actuator member transverse the media feed direction to engage the media edge alignment guide.

7. The media picking device of claim 1, wherein the carriage further includes a latch such that with the carriage positioned on the shaft the latch is adjacent to a free end of the shaft and is moveable into engagement with the shaft.

8. The media picking device of claim 7, wherein the latch is a spring-biased latch such that with the carriage positioned on the shaft the latch is biased for engaging with the shaft.

9. A media feed system in an imaging apparatus, the media feed system comprising:

a housing including an opening;

a media tray for holding a media stack, the media tray being removably insertable through the opening into the housing and including a media side edge guide adjustably mounted therein for moving to a selected position corresponding to a width of one or more media sheets of the media stack;

a shaft for receiving torque from the imaging apparatus;

a pick mechanism slidably mounted on the shaft and having at least one pick roller driven by the shaft to pick a topmost media sheet of the media stack in a media feed direction; and a translation mechanism coupled to the pick mechanism, the translation mechanism comprising:

a carriage coupled to a portion of the pick mechanism and slidably attached to a platform in the housing; and an actuator member slidably attached to the platform and engageable by the media side edge guide upon insertion of the media tray into the housing, the actuator member operatively coupled to the carriage such that, when the media tray is being inserted into the housing, the media side edge guide engages with and moves the actuator member which moves the carriage along the shaft thereby moving the pick mechanism to a position about a centerline of the width of the one or more media sheets and the pick mechanism and the carriage translate in the same direction as the actuator member a distance that is substantially half of a distance traveled by the actuator member.

10. The media feed system of claim 9, wherein a range of travel of the media side edge guide has a maximum extent approximately equal to a width of the media tray.

11. The media feed system of claim 9, wherein the platform includes a plurality of slots where the carriage and the actuator member are each slidably retained.

12. The media feed system of claim 9, wherein the translation mechanism further comprises a stack height sensor mounted to the carriage for sensing an angular position of the pick mechanism that changes as a height of the media stack held within the media tray changes.

13. The media feed system of claim 12, further comprising a lift mechanism pivotally mounted in the media tray, wherein the lift mechanism is operatively coupled to the stack height sensor for elevating the media stack in response to an output of the stack height sensor that corresponds to the height of the media stack so as to keep the topmost media sheet closely adjacent to the at least one pick roller.

14. The media feed system of claim 9, wherein the translation mechanism further includes a biasing member for continuously biasing the actuator member transverse the media feed direction to engage the media side edge guide.

15. The media feed system of claim 14, wherein the biasing member includes a return spring having a first end connected to the imaging apparatus and a second end connected to the actuator member, the return spring, when connected at the first end to the imaging apparatus, continuously biasing the actuator member transverse the media feed direction to engage the media side edge guide.

16. In an imaging apparatus having a platform for mounting a translation assembly for moving a pick mechanism therein about a centerline of a width of one or more media sheets held on a tray, the pick mechanism slidably mounted on a shaft that is disposed in the imaging apparatus and rotatable thereby, the tray having an edge guide moveable to a selected position corresponding to the width of the one or more media sheets, the translation assembly comprising:

a carriage coupled to a portion of the pick mechanism and slidably attached to the platform; and an actuator member slidably attached to the platform and engageable by the edge guide upon insertion of the tray into the imaging apparatus, the actuator member operatively coupled to the carriage such that, when the tray is being inserted into the imaging apparatus, the edge guide engages with and moves the actuator member which moves the carriage along the shaft so as to move the pick mechanism to a position about the centerline of the width of the one or more media sheets and the pick mechanism and the carriage move in the same direction as the actuator member a distance that is substantially half of a distance traveled by the actuator member.

17. The translation assembly of claim 16, wherein the carriage further includes a latch such that with the carriage positioned on the shaft the latch is adjacent to a free end of the shaft and is moveable into engagement with the shaft.

18. The translation assembly of claim 17, wherein the latch is a spring-biased latch such that with the carriage positioned on the shaft the latch is biased for engaging with the shaft.

19. The translation assembly of claim 16, further comprising a gear mechanism to operatively couple the actuator member and the carriage to each other.

20. The translation assembly of claim 19, wherein the carriage includes a first gear rack and the actuator member includes a second gear rack, the first and second gear racks operatively coupled to the gear mechanism, and wherein, upon movement of the actuator member, the second gear rack rotates the gear mechanism, which moves the first gear rack moving the carriage along the shaft in the same direction that the actuator member moves.

21. The translation assembly of claim 16, further comprising a return spring having a first end connected to the imaging apparatus and a second end connected to the actuator member, the return spring continuously biasing the actuator member transverse a media feed direction to engage the edge guide.

* * * * *